US005186119A

United States Patent [19]

Hlavin

[11] Patent Number: 5,186,119

[45] Date of Patent: Feb. 16, 1993

[54] MODULAR MARKING SYSTEM FOR ATHLETIC FIELDS

[75] Inventor: Dale J. Hlavin, Westlake, Ohio

[73] Assignee: Markers, Inc., Avon Lake, Ohio

[21] Appl. No.: 876,770

[22] Filed: May 1, 1992

[51] Int. Cl.[5] ..... A63F 9/00; G09B 29/10; G09F 7/18

[52] U.S. Cl. ..... 116/222; 33/1 G; 40/598; 116/209; 116/201; 273/25; 273/55 R; 273/411

[58] Field of Search ..... 116/209, 222; 273/411, 273/34, DIG. 26, 31; 248/156; 33/1 G; 40/598

[56] References Cited

U.S. PATENT DOCUMENTS

| | | | |
|---|---|---|---|
| 335,579 | 2/1886 | Gutzloe | 273/31 |
| 3,067,717 | 12/1962 | Imparato | 273/34 R |
| 3,213,824 | 10/1965 | Jenkins | 116/209 |
| 3,317,168 | 5/1967 | Ziph | 248/156 |
| 3,342,157 | 9/1967 | Sexton | 116/209 |
| 3,371,647 | 3/1968 | Shopbell | 116/209 |
| 4,532,712 | 8/1985 | Vistain | 273/DIG. 21 X |
| 4,787,601 | 11/1988 | Rybac | 256/19 |
| 5,014,983 | 5/1991 | Saunders | 248/156 X |

FOREIGN PATENT DOCUMENTS

| | | | |
|---|---|---|---|
| 0142477 | 12/1930 | Switzerland | 273/34 R |

*Primary Examiner*—Daniel M. Yasich
*Attorney, Agent, or Firm*—Thomas M. Schmitz

[57] ABSTRACT

A modular marking system for permanently marking the playing field on an athletic field with removable upright visible markers containing a variable diameter spring means for attaching an above ground, upright visible marker to a ground anchor. The variable diameter spring means comprises heavy gauge coiled steel having a large diameter coil section disposed within the ground anchor and a small diameter coil section secured within the upright visible marker, where the intermediate diameter reduction area is approximate to ground level to facilitate bending at ground level upon impact from any direction. The ground anchors permanently mark critical intersecting points of playing field lines, where the ground anchors can be used for aligning and visible marking playing field lines and subsequently for supporting the upright visible markers. The modular marking system is particularly useful for permanently marking different playing fields on the sme athletic field.

26 Claims, 2 Drawing Sheets

MODULAR MARKING SYSTEM FOR ATHLETIC FIELDS

This invention pertains to improved and simplified marking systems for athletic fields and more particularly to an efficient marking system for permanently marking athletic. fields and accurately positioning of hazard-free upright marking devices used in various sporting events.

BACKGROUND OF THE INVENTION

Athletic games and other gymnastic sporting events are frequently held outdoors on multi-purpose athletic fields. Sporting events such as football, soccer, and baseball are held on the same athletic field at different times but require different boundary and sideline markings as well as various line markings within the designated playing field. Football fields, for instance, require sidelines, hash marks, goal lines, and intervening yard lines while soccer fields contain sidelines, goal lines, mid-field stripes, and similar line markings. Although football and soccer are rectangular playing fields, the line markings are different. Baseball fields require foul lines and playing field boundary lines which frequently include an outfield periphery fence marking the end of the playing field. Baseball field orientations are completely different and frequently are cross-orientated to football and soccer field orientations. Athletic fields, especially for schools, are frequently used for major competition as well as for gym classes, including flag or touch football and hence, the markings need to be changed frequently on a weekly or even daily basis to accommodate the specific sporting event. Athletic fields dedicated to one sport need to be remeasured and resurveyed at the beginning of each year and ordinarily visible lines are re-marked each week with visible line markings such as chalk or paint lines prior to each sporting event due to loss of the markings from wear and weather conditions. Existing marking devices are not permanent markers for marking visible lines and often disappear due to vandalism or become obscured to overgrowth. Many devices are safety hazards which can cause injuries to players who inadvertently come in contact with the ground devices or the upright marker. Marking devices such as wooden stakes or plastic posts or cones are inaccurate and unsafe. In essence, athletic fields need to be permanently marked for multiple sport activities and remain consistent for everyday use without the need for resurveying the field. Accordingly, it would be desirable to provide a permanent marking system for an athletic field where critical marking points for a single sport or multiple sporting events can be permanently located on an athletic field in conjunction with positioning upright marking devices securely anchored to the ground and non-hazardous to the players but easily removable after the sporting event.

It now has been found that specially designed marking systems for marking athletic fields comprising permanent flush ground anchors located at critical points, a removable marking means for aligning visible chalk lines on the athletic field, and a plurality of upwardly extending removable markers where each contains an internal spring mechanism particularly adapted to bend 360° upon impact from any direction efficiently provides a simplified marking system for locating permanent marking devices and visible line markings for various athletic events in conjunction with setting up hazard-free visible upright markers for the intended athletic event. The field marking system comprises laying out locations where boundary and line markings are needed, locating pilot holes in the ground at strategic points, and inserting the ground anchors. The athletic field can be lined by inserting a removable lining peg or post into the ground anchor and by stringing a marking line from peg to peg to create a straight guide line for aligning and applying visible marking lines on the playing field. The marked athletic field is readied for use by removing the lining pegs and inserting upright visible markers in the ground anchors where appropriate. After the athletic event is completed, the upright markers can be removed and stored in a lightweight carrying bag while the ground anchors remain in the ground permanently from event to event or year to year without the need for resurveying the same athletic field. If the same athletic field is used for other sporting events, the second athletic playing field can be similarly surveyed and strategically marked with a second set of permanent ground anchors where each set is readily identified by a different identifying indicia. Once the ground anchors for each sport have been appropriately located, the same athletic field can be readily converted from a football field to a soccer field for instance, within minutes by merely removing one set of marking devices and by identifying and using the appropriate second set of ground anchors to set up an efficient and reliable marking system for the next sporting event with little effort. Hence, the versatile multiple use athletic field can be permanently marked with safe ground anchors which remain consistent from event to event and year to year. The ground anchors and the upright marking devices are all designed for safety and durability including a coiled spring means for attaching the upright marker to a ground anchor, whereby impact by athletes from any angle will not harm the athletes.

The efficient marking system of this invention provides an accurate athletic field marking system for consistency in field layout and marking from event to event and from year to year with the flexibility to accommodate multiple sporting events at different times. The unique modular design system accommodates multiple sets of marking devices to accommodate increased levels of sporting events, physical education, and recreational needs. Risk of player injuries upon impact with the highly visible upright markers are essentially eliminated due to the safety structures of each upright marker. Although the ground anchors are permanent, the attaching coiled spring means used in the anchor sockets are removable whereby the same ground anchors are used for lining the field prior to the sporting event in addition to marking the necessary marking points during the athletic event. When the ground anchors are properly installed in an accurately surveyed athletic field, the permanent ground anchors remain in place for subsequent playing field alignment identification, simplified field chalk lining, and efficient installation of safe marking devices. These and other advantages of this invention will become apparent from the drawing and detailed description of the invention.

SUMMARY OF THE INVENTION

Briefly, the marking system for marking athletic fields in accordance with this invention comprises locating ground anchors in the ground at strategic points for accurate lay-out and subsequent athletic field identification, marking simplified visible lining, and providing precise visible markers during athletic events. Each ground anchor contains a central socket and a flat upper flange defining the socket opening at ground level. A plurality of ground anchors are permanently sunk into the ground to mark the athletic field at strategic points of the playing field area. In preparation for use, some of the ground anchors are fitted with removable lining pegs for alignment purposes to freshly apply visible marking lines on the field. The lining pegs are removed and upright game marking devices can be inserted within the same ground anchors. Each upright visible marking device is fitted with a bendable coiled spring means comprising a coiled, heavy gauge, steel spring having a below ground enlarged outside diameter coil inserted into the ground anchor socket and an above ground narrowed outside diameter coil inserted into a soft flexible upright marker, whereby the upright visible marking device is operative to move and/or collapse 360° upon impact from any angle or direction without jarring loose from the ground anchor. After impact and collapse, the spring operated upright marker returns to its original position after the impacting force is removed. The marking system of this invention is particularly suitable for use for marking multiple sporting fields on the same athletic field.

DETAILED DESCRIPTION OF THE INVENTION

Figure 1:
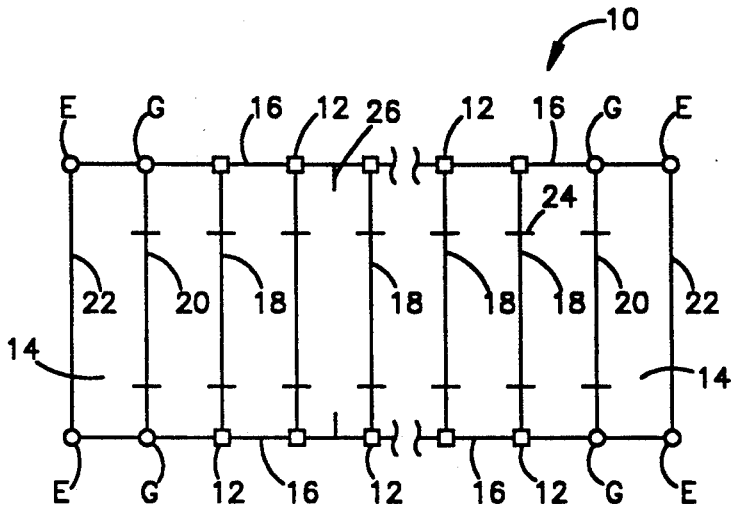
FIG. 1 is a plan view of a football athletic field surveyed and marked according to the modular marking system of this invention.

Referring now to the drawings wherein like reference characters designate like parts, shown generally in FIG. 1 is a football athletic field 10 typically surveyed and lined to provide a 100 yard playing field set-off in ten-yard increments and marked by transverse ten-yard markers 12 where the football field is terminated at either end with a goal line marker G and an additional ten-yard end zone 14 terminated with an end zone marker E. The field line markings comprise lateral side lines 16 intersected at right angles with the transverse ten-yard line markings 18, goal line markings 20, and end zone markings 22. Each ten-yard line intersects the side lines 16 at intersection points 12 while the goal line 20 intersects side line 16 at G and the end zone line 22 intersects the side lines 16 at E. Soccer playing fields are similarly arranged but ordinarily with a goal line G at either end of the field and an intervening midfield line along with box lines in front of the soccer goal. Additional small line markings on football fields ordinarily include a plurality of short hash marks 24 aligned in parallel and inset from side lines 16 where a hash mark 24 crosses a ten-yard line marking 18 and goal line 20 at right angles. Similarly, short line markings 26 mark five-yard intervals between adjacent ten-yard line markings 18.

Figure 2:
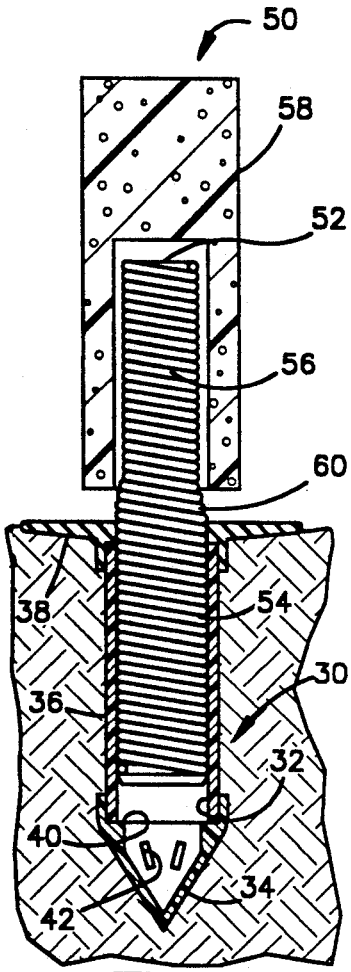
FIG. 2 is a front elevation sectional view of a typical upright marker shown in FIG. 1.
Figure 3:
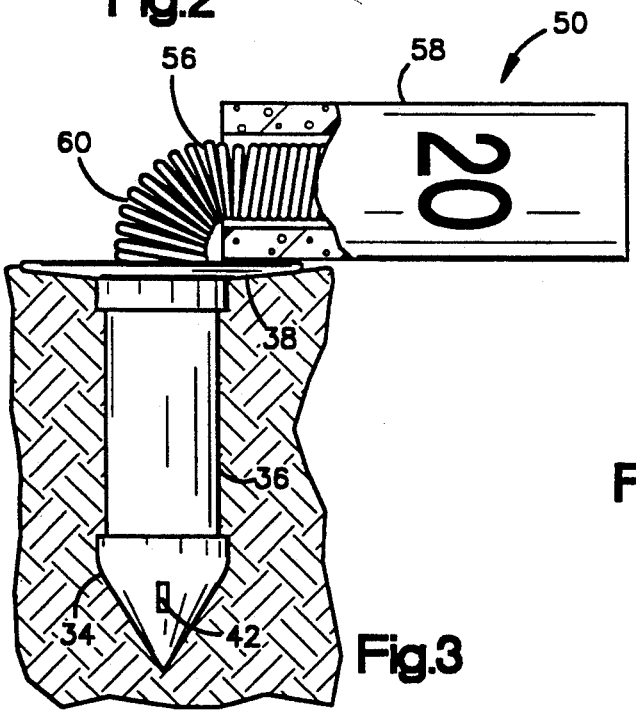
FIG. 3 is a front elevation view of the upright marker in FIG. 1 shown partially in section and collapsed in a lateral position.

Referring now to FIGS. 2 and 3, each line marker intersection 12, G, and E are marked with a permanent ground anchor 30 preferably of the type shown in U.S. Pat. No. 4,787,601 which is incorporated herein by reference. Preferably hash mark 24 intersects with each goal line G and five-yard 26 intersects with side lines 16 and can be marked with ground anchors 30 for alignment and line marking purposes. Ground anchor 30 is best viewed in vertical section in FIG. 2 and preferably is molded from high density rigid plastic such as polyvinyl or polyethylene. Ground anchor 30 contains an internal central vertical cavity or socket 32 defined by a lowermost angled point 34 extending upwardly with inverse conical shape sidewalls or similar convenient polygonal shape to engage a cylindrical or matching cross-sectional polygonal intermediate hollow tube 36 fitted with an uppermost peripheral flat collar 38 which defines the ground level opening of the socket 32 and preferably extends beyond the outer periphery of the cylindrical intermediate tube section 36. The uppermost peripheral collar 38 is adapted in use to be at ground level and preferably comprises molded resilient elastomeric material such as polyurethane or rubber. Inside the tapered point 32 are a plurality of circumferentially spaced molded vertical stops 40 integrally molded into the interior conical shaped sidewalls where the stops 40 can be used to support a vertical post if desired or a solid rod or the like for forcing the ground anchor 30 into the ground. The lowermost angled point 34 further contains a plurality of circumferentially spaced openings 42 in the conical sidewalls preferably located laterally between and vertically below stops 40, whereby the conical tapered point 34 is adapted to drain ground water which may collect within the anchor 30. The uppermost resilient elastomeric collar 38 is adapted to be flat or flush with the ground level in use.

Figure 9:
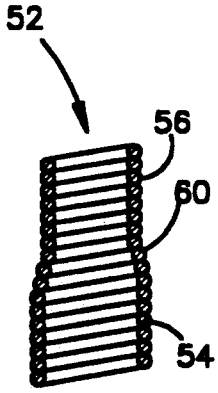
FIG. 9 is an enlarged, partial sectional view taken along lines 9—9 in FIG. 7 of a coiled spring removed from the ground anchor.

Referring now to the upright visible markers adapted to be removably fitted within ground anchors 30 in accordance with the invention, shown in FIG. 2 is a spring supported upright visible marker 50 typically comprising a vertical elongated cylindrical or a square pylon for goal G and end zone E markers while yard markers 12 frequently are square or rectangular cross-sectional pylons. Visible pylons 50 are typically about 12 to 24 inches in height. The upright visible marker 50 is supported by an internal variable diameter continuous tightly coiled, heavy gauge steel wire spring means 52 having a large diameter lower coiled section 54 disposed securely within the ground anchor socket 32 and an above ground small diameter coiled section 56 supporting the visible upright marker 50. The coil spring means 52 contains a diameter reduction section 60 where the large diameter coil section 54 becomes reduced and integrated into the upper smaller diameter coil section 56 at a point approximate to the upper flange surface of the anchor collar 38 and preferably approximately above the anchor collar 38. As best viewed in FIG. 3, the coiled spring means 52 is particularly adapted to bend at the diameter reduction juncture 60 without dislodging the lower coil section 54 from the ground anchor socket 32. The diameter reduction section 60 of the variable diameter coil steel spring 52 preferably is a graduated transition section comprising 2, 3 or 4 transitional coils having a coil diameter progressively smaller than the lower large coil section 54 and regressively larger than the smaller upper section coil 56, as best viewed in FIG. 9. The variable diameter reduction midsection 60 of the coiled spring means 52 readily bends at reduction juncture 60 but due to the high spring tension within the tightly coiled heavy gauge steel spring, the individual coils in diameter reduction midsection 60 do not appreciably separate and spring tension readily returns the visible marker 50 to an upright position without an instantaneous abrupt snap-back reaction. The diameter reduction juncture 60 facilitates the bending and tempers the snap-back which ordinarily takes about one to two seconds for an unobstructed return to the upright position. In contrast, a constant diameter high tension coiled spring will not readily bend and further exhibits undesirable snap back. The diameter reduction at junction 60 relative to the large lower spring 54 can be between about 5% and 35% where preferred diameter reduction is between about 9% and 30%, where larger diameter coils have larger reductions. Preferred useful outside diameters for the lower large coil section 54 can be between about 1 and 1.8 inches and for the smaller upper coil section 56 can be between about 0.8 and 1.6 inches. For example, a 1.15 inch outside diameter for a lower large coil spring section 54 can be reduced about 9% to a 1.05 inch outside diameter small spring coil upper section 56. Similarly, a 1.50 inch O.D. large diameter lower coil section 54 can be reduced about 25% at reduction point 60 to provide 1.15 O.D. small diameter upper coil section 56. Similarly, a 1.8 inch outside diameter lower coil section 54 can be reduced about 30% to a 1.3 inch outside diameter upper coil section 56.

Useful coiled springs 52 can be produced from heavy gauge steel wire having a preferred U.S. Steel Wire Gauge No. between about 1 and 11 and preferably between about 3 and 7 where 5 gauge galvanized steel wire is particularly useful. Steel wire thickness measured in inches can be between about 0.12 and 0.28 inches and preferably between about 0.18 and 0.24 inches where about 0.2 inch diameter steel wire is particularly desirable. Steel wire can be progressively coiled by cold winding steel wire tightly on a variable diameter mandrel to form the variable diameter coiled spring 52. Useful coiled spring means 52 should be at least 6 inches in length and preferably between about 8 and 14 inches in vertical length although longer spring means 52 can be utilized if desired.

The visible marker pylon 50 includes an above ground soft flexible elastomeric foam structure 58 such as polyurethane foam or polyethylene foam attached internally to the coiled spring means 52 and wrapped in an illuminescent nylon cover sheath or other fabric sleeve which can contain a yard line number or other marking indicia as shown in FIG. 3. The nylon cover is removable for cleaning purposes and can be secured by a tie at the bottom of the poly-foam structure. Each soft flexible foam upper structure 58 typically has a standing height of 14 to 20 inches for a football field marker and contains an internal cylindrically or rectangularly shaped vertical cavity adapted to receive and tightly engage the upper coiled spring section 56. The bottom of the upright foam structure 58 terminates approximate the diameter reduction point 60 of the coiled spring 52 and preferably just above the diameter reduction point 60 to ensure free bending in conjunction with the coiled spring means 52 without interference with spring 52 or the anchor collar 38. The enlarged bottom coiled section 54 provides stiffness and stability with secure engagement with the ground anchor 30 while the smaller upper coiled spring section 56 provides resilience in conjunction with the bending action of the diameter reduction midsection 60 to provide the necessary bending of the spring means 52 without jarring upright marker 50 loose from the ground anchor socket 32. This is particularly important for goal line markers G which must accurately bend upon impact since the direction in which the upright marker 50 bends and falls to the ground upon impact with a player dictates whether the player is out of bounds, has scored, or has not scored.

Figure 4:
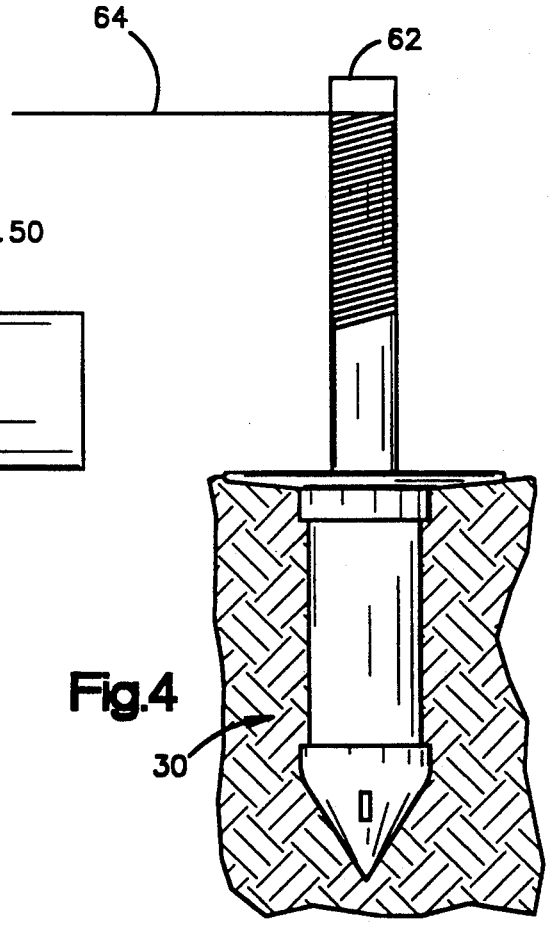
FIG. 4 is a front elevation view of a lining post or peg for aligning visible marking lines on the athletic field shown in FIG. 1.

Referring now to FIG. 4, shown is a ground anchor 30 containing a cylindrical lining post or peg 62 loosely disposed within a ground anchor socket 32 and adapted to rotate freely while resting on vertical stops 40 located at the upper internal periphery of the anchor point 34 to enable free rotation of the lining peg 62 within the ground anchor socket 32. The above ground upper part of the lining peg 62 contains continuous lining string 64 adapted to unwind a finite distance as desired by pulling the string 64 and freely rotating the lining peg 62. The lining peg 62 and lining string 64 are aligned with a second lining peg 62 (alignment peg) in an opposed matching ground anchor 30 for purposes of providing a straight line to facilitate marking straight chalk lines between the lining peg 62 and the alignment peg on the athletic field.

In accordance with this invention, the ground anchors 30 are permanently positioned in the ground in a grid pattern for a football field as shown in FIG. 1. The football athletic field is marked with visible line markings of chalk or paint lines 16, 18, 20, and 22 by aligning the lining post 62 with a companion lining post 62' at the grid points 12, G, or E. Thus, for example, a lining peg 62 can be inserted in point E on the left side of the football field and linearly aligned with a companion alignment peg inserted in point E at the right side of the football field. This alignment can be used to chalk or paint the lower disposed side line 16 while a similar alignment can be set up to chalk or paint the upper disposed side line 16 as viewed in FIG. 1. In a similar manner, transverse yard lines 18 or goal lines G or end zone lines E can be chalked or painted by inserting a lining peg 62 in the proper ground anchor 30 and a companion alignment peg in the ground anchor 30 opposite the lining post 62. For instance, each goal line can be chalked or painted by aligning the lining peg 62 in the lower sideline anchor socket G and inserting a companion alignment peg in the opposed upper sideline anchor socket G as viewed in FIG. 1. Transverse yard lines 18 can be similarly chalked or painted by aligning matching pairs of sockets 16 to mark each ten-yard line 18. If desired, short intermittent hash marks 24 can be similarly aligned in a straight line by aligning an anchor 30 located at end zone line 22 at one end with another anchor 30 at end zone line 22 at the other end of the field for each line of hash mark 24. Similarly, the short five-yard line marks 24 can be aligned between opposed ground anchors 30 located at intersecting points with opposed side lines 16 to align and visibly mark the short five-yard lines 24.

Figure 5:
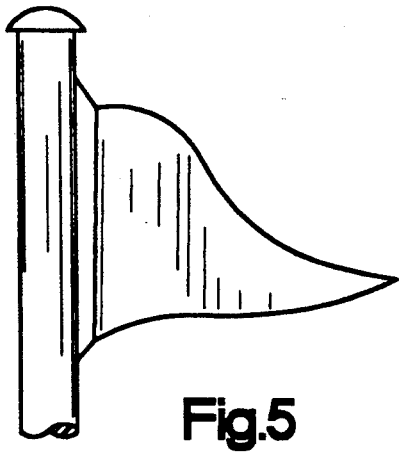
FIG. 5 is a front elevation view of an alternative upright marker comprising a marking post.

Referring now to FIG. 5, shown is an upright marker comprising a cylindrical hollow rigid plastic post 68 fitted with a coiled spring means 52 having smaller diameter upper spring section 56 inserted within the hollow post 68 and an enlarged diameter lower spring section 56 inserted within a ground anchor 30. The coiled spring means 52 contains diameter reduction midsection 60 disposed approximate to and preferably just above the ground level and the top surface of the anchor flat collar 38, whereby the post 68 is adapted to readily bend 360° upon impact from any direction. The plastic posts 68 are particularly useful for marking corners and the midfield line of a soccer field as well as for marking field hockey side lines and cross-country courses. Similar to football fields, a soccer field can be set up by strategically locating ground anchors 30 at the intersection of the side lines with goal lines and midfield lines. Typically each soccer goal is lined in a rectangular outline encompassing the soccer goal with additional space in front of the soccer goal net to mark the goal keeper's playing space. A plurality of anchors 30 permanently mark all corners of the soccer field and the goal box whereby the soccer field can be readily set up or converted from a football field or athletic field by merely locating the appropriate set of ground anchors 30, lining the sidelines, goal lines and goal keeper's boxes with chalk or paint by using a lining post 62 and string 64 with an alignment post, and then inserting the marker posts 68 at the corners and the midline of the soccer field. If desired, a centrally disposed ground anchor 30 can be used as a center point for marking circles, partial circles, or arcs in the same manner with a center point marking peg 62 and string 64 marking the arc or perimeter of the visible field line at a constant radius. Thus, a football field and a soccer field can occupy the same athletic field where the permanent ground anchors permanently mark each field playing area, and, within minutes each field can be accurately lined and set up for play. By removing the football marking pylons 50 from one set of ground anchors and inserting soccer corner posts 68 in the appropriate second set of ground anchors 30, the football field can be readily converted to a soccer field without significant delay. The upright football pylon markers 50 and the soccer post markers 68 are removable and each are fitted with coiled springs adapted to readily bend 360° upon impact from any direction and thereafter spring back to an upright position in accordance with this invention.

Figure 6:
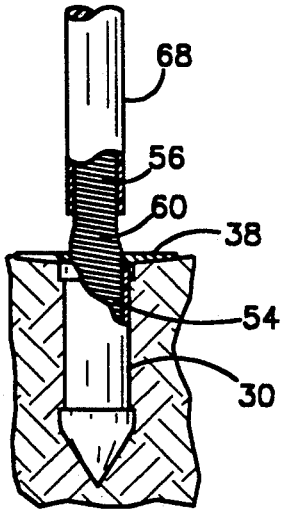
FIG. 6 is a front elevation view of a fence section utilizing upright posts similar to the post shown in FIG. 5.
Figure 6:
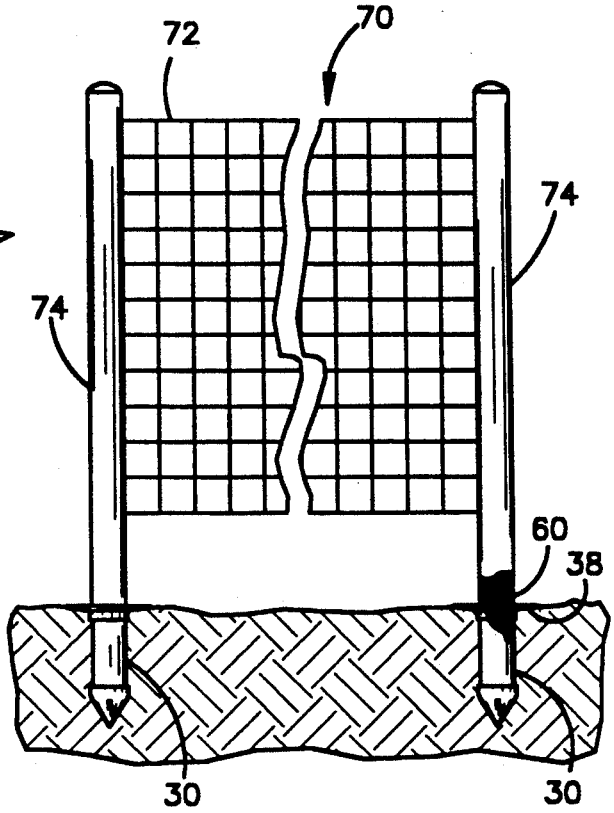

Referring now to FIG. 6, shown is a front elevation view of a fence section 70 comprising preferably an elastomeric or synthetic polyflexible fencing material 72 stretched between two fence posts 74 each fitted within a ground anchor 30. Each fence post 74 is constructed in the manner shown in FIG. 5 consisting of an upright hollow plastic tube containing a coiled spring 52 inserted within each fence post 74 as well as the matching ground anchor 30. Each coiled spring 52 comprises an enlarged diameter spring section 54 in the ground anchor 30 and a smaller diameter spring section 56 in the fence post 74 with an intervening diameter reduction 60 located just above ground level and approximately above the top surface of the anchor collar surface 38 as described in respect to FIG. 5. The fence section 70 is one of several fence sections which can be aligned in a continuous line in use to provide a continuous fence marking a perimeter of an athletic field such as an outfield fence or out of bounds fence marking the playing area for a baseball field. Each fence post 74 in the continuous fence is adapted to bend upon impact at the base section of the post 74 due to the coiled spring 52 connector between each post 74 and respective ground anchor 30 and particularly due to the diameter reduction 60 midsection of the coiled spring 52 located just above ground level. Upon impact from a player, the fence section 70 will bend with the impact regardless of direction of impact. The ground anchors 30 can be permanently set in a line to permanently mark the perimeter of the baseball playing field and readily permit insertion of the fence posts 74 to set up of the baseball field. Conversely, the fence posts 74 can be readily removed to convert the baseball field to another type of athletic field while the elastomeric ground anchors 30 remain in the ground without interference or safety hazard to the activities on the converted playing field.

Figure 7:
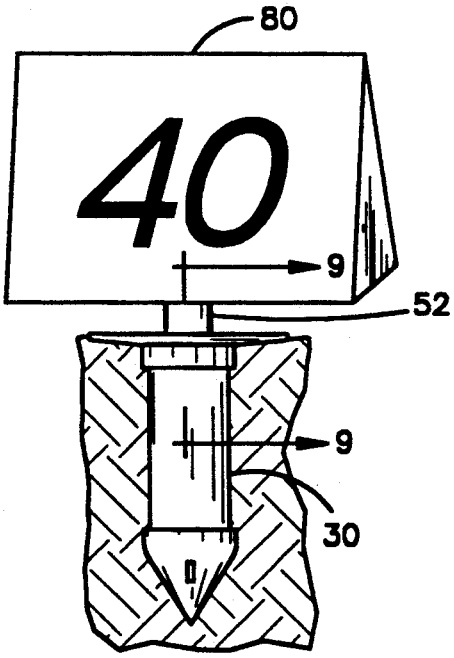
FIG. 7 is an alternative upright visible marker shown in FIG. 1.

Referring now to FIG. 7, shown in partial perspective is an alternative embodiment of an upright marker 80 shaped in rectangular or square with a triangular vertical cross-section and a parallelogram base where the marker 80 is supported in an upright position by a ground anchor 30. The vertical cross-sectional width can be narrow or wide as desired in conjunction with a narrow or wide rectangular base cross-section. The preferred upright marker 80 is an elongated, narrow, triangular vertical cross-section shape. The upright marker 80 is fitted with a coiled spring 52 having an enlarged diameter spring lower section 54 within the ground anchor socket 32 and a smaller diameter spring upper section 56 inserted and secured within the upright marker 80 including diameter reduction mid-section 60 just above ground level as shown in FIGS. 2 and 3, whereby the marker 80 will readily flex backwardly and forwardly upon impact without dislodging from the anchor socket 32.

Figure 8:
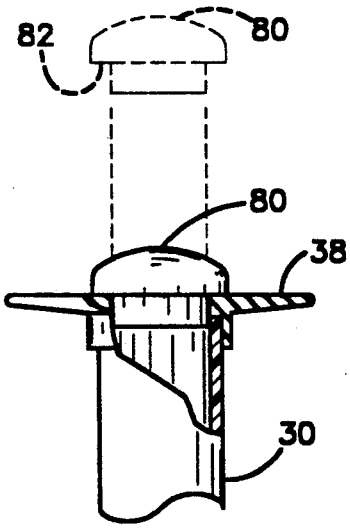
FIG. 8 is a front elevation view of a ground anchor shown in partial section with a protective plug or cap for capping the socket opening of the ground anchor.

Referring now to FIG. 8, shown is a protective cap or plug 80 adapted to fit within the opening in the collar 38 to the center socket 32 of the ground anchor 30 when the anchor 30 is not being used to protect the anchor socket opening from abuse and prevent ground water from unnecessarily accumulating within the anchor 30. The plug 80 can be elastomeric or plastic and is adapted to securely fit and lock within the anchor socket 32 opening defined by the anchor flat collar 38. The plug 80 comprises a small periphery lip 82 to engage by friction the outer periphery of the socket opening 32 in the anchor collar 38. To remove the plug 80 and enable use of the ground anchor 30, a small screw driver point can be inserted beneath the peripheral lip 82 of the plug 80 and pivoted upwardly to dislodge the plug from the opening in the anchor collar 38. Thus, when one set of anchors are in use, the second set of anchors can be closed with plugs 80. Each set of anchors can be appropriately marked with an identifying means such as a color dot or line to identify all anchors which mark a particular sports field such as a football field. Alternatively, matching color plugs 80 can be used to identify matching anchors for lining a sports field. The plugs 80 can be readily removed for use of the anchors 30 and readily replaced after the sports event.

In accordance with this invention, the ground anchor 30 having a upper flat collar 38 and a lower protruding point 34 can be easily inserted into the ground to permanently mark the location of various boundary lines required for different sporting events. The boundary lines for one or more sporting events on the same athletic field can be permanently marked by inserting anchors 30 at strategic points for lining purposes. The anchors 30 can be pounded into the ground until the anchor collar 38 is ground level and essentially flush with the ground. Although growing grass or ground movement may cover anchors 30, the ground anchors 30 are easy to identify but nevertheless difficult to vandalize or remove without a tool. When the playing field is being set up for use, plugs 80 can be removed from the anchors 30 and lining posts 62 can be inserted where required and lines 64 can be stretched to companion alignment posts whereupon the appropriate marking line can be chalked or painted in alignment with line 64. In accordance with this invention, at least some or all of the marking anchors 30 are subsequently utilized as ground anchor sockets 32 for holding upright visible markers required in the particular sporting event. The upright visible markers 50 can be appropriately located within each respective ground anchor 30 by simply inserting the depending coiled spring 52 of the upright marker 50 into the anchor socket 32 where the enlarged lower spring section 54 fits within the socket 32 and the diameter reduction 60 is located approximately above the anchor collar 38 surface, whereby the spring diameter reduction 60 facilitates flexible bending of the coiled spring 52 upon impact from any direction. The flush anchor collars 38 avoid safety hazards during sporting events. After the sporting event, the upright visible markers 50 can be removed and color identifying plugs 80 inserted in each anchor socket 32 opening for future identification. In preparation for the next sporting event, plugs 80 can be removed from the second set anchors marking the second athletic field. Lining posts 62 and lining strings 64 can be used to chalk or paint boundary and marking lines for the second sporting event using the second set of anchors 30. Upright visible markers 68 containing a safety coiled spring means 52 with a diameter reduction 60 can be inserted in the second set of anchors 30 and utilized as markers for the second sporting event.

The foregoing describes the marking system of this invention for permanently marking an athletic field, aligning the boundary lines for lining with chalk or paint, marking strategic points in the athletic field with spring loaded upright markers, and converting the markers to an unmarked athletic field or a second sporting event field, but is not intended to limit the invention except by the appended claims.

I claim:

1. An upright marking means for visibly marking playing field lines on an athletic field for a sporting event, comprising:

a ground anchor adapted to be inserted into the ground, the ground anchor containing a vertical central socket and a ground level upper peripheral collar defining a ground level opening of the anchor central socket;

an upright visible marker comprising an above ground structure containing a vertical channel for receiving supporting means to support the marker vertically above the ground anchor; and a vertical support means consisting of a variable diameter coiled spring means vertically disposed within the ground anchor socket and secured within the vertical channel of the upright visible marker, the spring means comprising a tightly coiled heavy gauge steel wire having a metal gauge thickness between about 1 and 11, where said coiled spring means contains a lower spring section having a large diameter coil fitted within the anchor socket, an upper spring section having a small diameter coil disposed within the vertical channel and secured to the upright marker, and an intermediate transition coil section between the large diameter lower coil and small diameter upper coil located proximate to the ground level collar of the anchor whereby the upper coil section of the spring means and upright visible marker are adapted to bend laterally upon impact.

2. The upright marking means of claim 1 where the small diameter upper coil section has a coil diameter reduced in size between about 5% and 35% relative to the diameter of the large diameter lower coil section.

3. The upright marking means of claim 1 where the heavy gauge steel wire in the coiled spring means has a wire thickness between about 0.18 and 0.24 inches.

4. The upright marking means of claim 1 where the anchor socket is defined by a cylindrical wall and the large diameter coil section is in removable engagement with the cylindrical wall.

5. The upright marking means of claim 1 where the intermediate transition coil section is located approximately above the upper peripheral collar of the ground anchor.

6. The upright marker means of claim 1 where the outside diameter of the large diameter lower coil section is between about 1 and 1.8 inches.

7. The upright marker means of claim 1 where the outside diameter of the small diameter upper coil section is between 0.8 and 1.6 inches.

8. The upright marking means of claim 1 where the coiled spring means is between about 8 inches and 14 inches in length.

9. The upright marking means of claim 1 where the upright visible marker comprises a flexible elastomeric foam structure supported by and secured to said variable diameter spring means.

10. The upright marking means of claim 9 where the elastomeric foam upright marker is covered with an illuminescent fabric sleeve containing a visible marking indicia.

11. The upright marking means of claim 1 where the visible marker comprises a vertical post.

12. The upright marking means of claim 1 where the visible marker comprises two or more upright posts having a flexible fencing stretched and secured between adjacent upright posts.

13. The upright marking means of claim 12 where a plurality of posts are interconnected with flexible fencing to provide a continuous marking fence for marking the end of the sporting event playing field.

14. The upright marking means of claim 1 where the peripheral collar of the ground anchor comprises a resilient elastomeric material.

15. A method of marking visible game marking lines on an athletic field for a sporting event playing field comprising:

locating critical marking points on the athletic field, the critical marking points determined by marking the intersection points of field marking lines defining the sporting event playing field;

inserting a plurality of ground anchors into the athletic field ground essentially flush with the ground, where one of the ground anchors mark each intersection point of the field marking lines and each ground anchor contains a central socket;

applying visible marking lines on the athletic field, where each visible marking line is applied by inserting a rotatable lining peg into one of the ground anchor sockets and aligning the lining peg with an alignment peg disposed in another ground anchor socket aligned on a straight line coinciding with one of the field marking lines, stretching a string between the lining peg and the alignment peg, and marking a visible marking line on the athletic field aligned with the stretched string;

removing the marking pegs and alignment pegs from the ground anchors and inserting upright visible markers in at least some of the ground anchors to mark strategic points on the sporting event playing field, where said upright visible markers each contain a variable diameter depending coiled spring means inserted within one of the ground anchor sockets, where each upright visible marker is adapted to bend laterally at approximately ground level upon impact without dislodging from the ground anchor; and removing said upright visible markers from the ground anchors after completion of the sporting event.

16. The method of claim 15 where the game marking lines include field marking lines within the playing field.

17. The method of claim 15 where the lining peg contains a string winding and the lining peg is adapted to rotate in the ground anchor socket, where said string is adapted to unwind and stretch in linear alignment with the alignment peg.

18. The method of claim 15 where the upright visible markers are removed and a closure plug is inserted into an opening in the socket of each ground anchor.

19. The method of claim 15 for marking the athletic field with field marking lines of a football playing field, where the field marking lines comprise two laterally spaced parallel side lines intersecting at right angles with transverse laterally spaced end zone lines, goal lines, and intervening yard lines forming a football field grid pattern, where the intersections of the parallel side lines with the transverse yard lines define critical marking points of the football playing field.

20. The method of claim 15 for marking the athletic field with field game lines of a soccer playing field comprising laterally spaced parallel soccer side lines intersecting at right angles with laterally spaced soccer goal lines and an intervening parallel midfield line to provide intersecting critical marking points for the soccer playing field.

21. The method of claim 20 where the soccer critical marking points each contain a ground anchor supporting an upright visible marker comprising a vertical post containing a downwardly depending coiled spring means inserted within the ground anchor socket.

22. The method of claim 15 where the athletic field is a multiple sport athletic field used for two or more sporting events at separate times, and the sporting event playing field for each sporting event is marked by a separate set of ground anchors, where each set of ground anchors is marked by a common identifying indicia.

23. The method of claim 22 where each set of ground anchors is plugged while in non-use by inserting an enclosure cap within the socket opening of each ground anchor, and the enclosure caps for each set of ground anchors contains the common identifying indicia.

24. A method of marking a sporting event playing field on an athletic filled, comprising:

inserting a plurality of ground anchors into the athletic field ground and essentially flush with the ground in a spaced linear pattern to provide marking points defining the playing area of the sporting event, where each ground anchor contains a central socket;

inserting an upright visible marker means into each ground anchor to provide a visible marking of the playing field area of the athletic field, where each upright visible marker means contains a variable diameter coiled spring means having a large diameter coil section below ground inserted within the ground anchor socket and a small diameter coil section above ground secured within the upright visible marker means, said coil spring means adapted to bend laterally at ground level upon impact without dislodging from the ground anchor, and said visible marker means is removed from the ground anchor after the sporting event.

25. The method of marking a sporting event playing field according to claim 24, where the plurality of ground anchors define the playing area of a baseball field, and the plurality of upright visible markers comprise vertical posts aligned in a continuous line where adjacent vertical posts contain flexible material stretched between the adjacent posts to provide a continuous marking fence to mark the perimeter of the playing area of the baseball field.

26. The method according to claim 25 where the baseball field has an outfield playing area, and the continuous marking fence is an outfield fence marking the end of the baseball playing area.

* * * * *